US007115084B2

(12) United States Patent
Chen et al.

(10) Patent No.: US 7,115,084 B2
(45) Date of Patent: Oct. 3, 2006

(54) REPLACEABLE FUSER MEMBER

(75) Inventors: Jiann-Chen Chen, Fairport, NY (US); Biao Tan, Penfield, NY (US); Joseph A. Pavlisko, Pittsford, NY (US); Muhammed Aslam, Rochester, NY (US); Allen Kass, Pittsford, NY (US); Nataly Boulatnikov, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/664,012

(22) Filed: Sep. 15, 2003

(65) Prior Publication Data

US 2004/0116264 A1 Jun. 17, 2004

Related U.S. Application Data

(60) Provisional application No. 60/433,155, filed on Dec. 13, 2002.

(51) Int. Cl.
*B25F 5/02* (2006.01)

(52) U.S. Cl. ..... 492/56; 492/54

(58) Field of Classification Search ..... 492/56, 492/54; 428/421, 422; 399/333
See application file for complete search history.

(56) References Cited

U.S. PATENT DOCUMENTS 5,323,702 A * 6/1994 Vrotacoe et al. ..... 101/217
5,577,443 A * 11/1996 Songer ..... 101/375
5,716,714 A * 2/1998 Chen et al. ..... 428/473.5
5,736,250 A * 4/1998 Heeks et al. ..... 428/447
5,918,098 A * 6/1999 Van Bennekom ..... 399/333
6,078,778 A * 6/2000 Murata et al. ..... 399/313
6,355,352 B1 * 3/2002 Chen et al. ..... 428/421
6,393,226 B1 * 5/2002 Charlebois et al. ..... 399/12
6,393,247 B1 * 5/2002 Chen et al. ..... 399/330
6,393,249 B1 5/2002 Aslam et al. ..... 399/333
6,429,249 B1 8/2002 Chen et al. ..... 524/432
6,696,158 B1 * 2/2004 Chen et al. ..... 428/421
6,716,502 B1 * 4/2004 Badesha et al. ..... 428/35.8
2002/0002921 A1 * 1/2002 Hoffman et al. ..... 101/376
2002/0134264 A1 * 9/2002 Okubo et al. ..... 101/401.1

* cited by examiner

*Primary Examiner*—Marc Jimenez
(74) *Attorney, Agent, or Firm*—Carl F. Ruoff

(57) ABSTRACT

A replaceable fuser member including a thin, seamless or welded high temperature nickel sleeve, a base cushion positioned around the sleeve, a primer coat of a silane coupling agent containing epoxies on the sleeve, and an outside coating applied over the base cushion elastomer layer. The sleeve is replaceable on a mandrel positioned in an electrophotographic copying machine in a fuser station of the electrophotographic copying machine.

18 Claims, No Drawings

REPLACEABLE FUSER MEMBER

CROSS REFERENCE TO RELATED APPLICATIONS

Reference is made to the following co-pending, commonly assigned application, the disclosure of which is incorporated herein by reference:

U.S. Provisional Patent Application Ser. No. 60/433,155, filed on Dec. 13, 2002, by Jiann-Hsing Chen et al., entitled: METHOD FOR PRODUCING A REPLACEABLE FUSER MEMBER.

FIELD OF THE INVENTION

This invention relates to a replaceable fuser member. The replaceable fuser member includes a thin, seamless or welded high temperature nickel sleeve, a base cushion positioned around the sleeve and an outside low surface energy coating applied over the base cushion elastomer layer. The sleeve is replaceable by installation on a mandrel positioned in an electrophotographic copying machine in a fuser section of the electrophotographic copying machine.

BACKGROUND OF THE INVENTION

In electrophotographic copying, an electrostatic latent image is formed on a primary image-forming member such as a photoconductive surface and is developed with a thermoplastic toner powder to form a toner image. The toner image is thereafter transferred to a receiver such as a sheet of paper, plastic or the like and the toner image is subsequently fused to the receiver in a fusing station using heat, pressure, or both. The fuser station includes fuser members, which typically are rollers, although fuser belts and the like may also be used. The essential function performed in the fusing section is the application of heat and pressure to the toner image on the receiver to fix the image to the receiver.

The fusing step is commonly carried out by passing the toner image-bearing receiver between a pair of engaged rollers that produce an area of pressure contact known as a fusing nip. In order to form the nip, at least one of the rollers typically includes a compliant or conformable layer. Heat is transferred from at least one of the rollers to the toner in the fusing nip causing the toner to partially melt and attach to the receiver. In the case where the fuser member is a heated roller, a resilient compliant roller having a smooth surface is typically used.

Where the fuser member is in the form of a belt, such as a flexible endless belt that passes around the heated roller, it typically has a smooth, hardened outer surface.

Most fuser stations, which are known as simplex fusers, attach toner to only one side of the receiver at a time. In such fusers, it is common for a first one of the two rollers to be driven rotatably by an external source. The second roller is then rotatably driven by frictional contact with the first roller. Similarly, heat is typically applied to only one of the rollers. The heat may be applied by the use of one or more heater rollers to heat the exterior of the heated fuser roller or the heat may be supplied internally to the heated fuser roller.

Two basic types of heated rollers have been used. One uses a conformable or compliant pressure roller to form a fusing nip against a hard, heated fuser roller. The other uses a compliant fuser roller to form the nip against a hard, heated and relatively non-conformable pressure roller. A fuser roller designed as compliant typically includes a conformable layer having a thickness greater than about 2 millimeters (mm) and in some instances greater than about 25 mm. A fuser roller designated as "hard" includes a rigid cylinder that may have a relatively thin polymeric or conformable elastomeric coating less than about 1.25 mm thick on its exterior. There are certain advantages associated with both compliant and non-compliant rollers.

Typically, fuser rollers include a conformable layer that may be formed of any suitable material such as, for instance, polydimethylsiloxane elastomer.

Typically, toner fuser rollers include a hollow cylinder core, which is often metallic, with a roller cushion layer formed about the roller. Such cushion layers are commonly made of silicone rubbers or silicone polymers having a low surface energy, such as polydimethylsiloxane, which minimize adherence of toner to the roller, especially the heated roller. It is also known that cured polyfluorocarbon polymers and copolymers may be used to coat the cushion layer surface to further reduce the tendency of the toner to adhere to the roller and minimize contact of release oils with the cushion layer.

The cushion layer may include fillers including inorganic particles such as metals, metal oxides, metal hydroxides, metal salts, mixtures thereof and the like. These materials function to improve the thermoconductivity of the cushion layer.

The filler particles may also strengthen or otherwise modify the physical properties of the cushion material. A wide variety of rollers have been produced in attempts to more economically produce rollers that are more effective in selected desired applications. For instance, one such roller for use in a fuser station and including a flexible strengthening band, a base cushion layer around the strengthening band, a stiffening layer around the base cushion and a release layer around the stiffening layer is disclosed in U.S. Pat. No. 6,393,249B1 issued May 21, 2002, to Muhammed Aslam, et al., and assigned to NexPress Solutions, LLC. This patent is hereby incorporated by reference.

It is also known that various fluoropolymers, such as thermoplastic fluorocarbon polymers and random copolymers, are useful as coatings on such rollers. Some such fluorocarbon thermoplastic polymers and thermoplastic random copolymers, including various additive materials, are disclosed in U.S. Pat. No. 6,355,352B1 issued Mar. 12, 2002, to Jiann-Hsing Chen, et al., and assigned to NexPress Solutions, LLC and U.S. Pat. No. 6,429,249B1 issued Aug. 6, 2002, to Jiann-Hsing Chen, et al., and assigned to NexPress Solutions, LLC. These patents are hereby incorporated by reference.

While silicone rubbers and silicone polymers have been used widely as cushion layers, they have also, in some instances, been used as an exterior layer. Fluoroelastomers and rubbers such as rubbers made of ethylene propylene diene monomers and the like have also been used as cushion layer materials. Unfortunately in many fusing processes the exterior of the fuser roller, in direct contact with the toner, particularly a heated fuser roller, is coated with a release oil during fusing. Such release oils are generally detrimental to the silicone rubbers and silicone polymers. Polyfluorocarbon polymers and random copolymers coated over the outside of the cushion layer have been found to be resistant to such oils and to provide a low energy surface which readily releases from the toner on the receiver and are not adversely affected by commonly used release oils.

Continued efforts have been directed to the development of replaceable fuser members for fuser rollers in electrophotographic applications. As will be readily appreciated, improvements in the properties of surface release roller performance with respect to its conformance to the other roller used to create the pressure nip and reductions in the cost of the production of the rollers and increased ease of installation and replacement, are major factors which have been the object of continuing efforts for improvement.

SUMMARY OF THE INVENTION

According to the present invention, it has been found that an improved replaceable fuser roller member includes: a high temperature nickel sleeve having an inner diameter adapted to closely fit around an outer diameter of a mandrel in an electrophotographic machine fuser section; a base cushion elastomer layer around an outside of the sleeve; a primer consisting essentially of a silane coupling agent containing epoxies positioned on the outside of the sleeve to provide bonding between the base cushion and the sleeve; and, a layer of a cured thermoplastic polymer selected from the group consisting of thermoplastic polyfluorocarbon polymers and thermoplastic polyfluorocarbon random copolymers around the outside of the base cushion.

The present invention further includes an improvement in a replaceable fuser roller consisting essentially of a high temperature nickel sleeve having an inner diameter adapted to closely fit around an outer diameter of a mandrel in an electrophotographic machine fuser section, a base cushion elastomer layer around an outside of the sleeve and a layer of a cured thermoplastic polymer selected from the group consisting of thermoplastic polyfluorocarbon polymers and thermoplastic polyfluorocarbon random copolymers, around the outside of the base cushion, the improvement including: positioning a primer consisting essentially of a silane coupling agent containing epoxies on the outside of the sleeve to thereby improve adhesion of the base cushion elastomer to the outside of the sleeve.

The improved roller provides for improved reliability and greatly improved ease of installation in an existing electrophotographic copying machine at a lower fabrication cost.

DETAILED DESCRIPTION OF THE INVENTION

According to the present invention, a replaceable fuser member is provided. The replaceable fuser member provides various advantages not provided by the prior art as noted above.

In particular, the present invention includes a customer replaceable fuser roller readily replaced on a mandrel in an electrophotographic machine by a machine user with minimum difficulty. The replaceable fuser roller member includes a thin, seamless or welded high temperature nickel sleeve, a base cushion elastomer cushion over the outside of the sleeve and a release topcoat over the outside of the base cushion. In particular, this invention provides a primer system that provides improved bonding of the base cushion to a special high temperature nickel sleeve.

The sleeve has typically been of any of a wide variety of conductive metals, such as aluminum, elastomers, plastic, silicone and the like. Desirably, the sleeve is a high temperature nickel. Nickel sleeves formed by electroforming nickel tend to outgas as the temperature is raised to the temperature necessary to cure the base cushion layer or the topcoat layer over the sleeve. As a result, it is highly desirable that the sleeve be of a high temperature nickel. High temperature nickel, as used in this application, refers to nickel that does not outgas, or release volatile compounds, at temperatures up to the maximum temperature required to cure the cushion layer and the topcoat elastomer layer over the fuser member. Such temperatures may be as high as, or even higher than 300° C.

Desirably, the mandrel is of the same metal as the sleeve. This is desirable so that the thermal expansion of the sleeve and the mandrel is closely matched. While some variation in thermal expansion can be tolerated, it is highly desirable that the expansion of the sleeve and the mandrel be approximately the same.

Desirably the sleeve is relatively thin. The reduced quantity of metal required for the thin sleeve contributes to the economical construction of the sleeve. Typical thicknessess of the sleeve are from about 0.001 to about 0.05 inches.

Typically, the sleeve is sized to slip over the mandrel with a relatively firm fit. Desirably, the inside of the sleeve has a diameter from about 0.001 to about 0.002 inches greater than the outer diameter of the mandrel. Greater tolerances may be necessary if the mandrel has a relatively rough surface. In general, it is desirable that the fuser member include a sleeve sized for ready positioning snugly around the mandrel in the electrophotographic machine so that the sleeve rotates with the mandrel. Sufficient tolerance should be provided to permit some thermal expansion of the mandrel greater than the expansion of the sleeve if necessary.

An important part of the present invention relates to the use of a primer consisting essentially of a silane coupling agent containing epoxies, which is positioned on the outside of the sleeve to provide good bonding between the base cushion and the sleeve. A variety of primers and adhesives have been used for this purpose, but it has been found that surprisingly superior results have been achieved with this particular primer. Particularly desirable results have been achieved when the sleeve is of a high temperature nickel. Typically, the primer contains at least one of the group consisting of (3-glycidoxypropyl)bis(trimethylsiloxy)methylsilane, 3-glycidoxypropylmethyldiethoxysilane, (3-glycidoxypropyl) methyldiethoxysilane, 3-glycidoxypropylmethyl-diisopropenoxysilane, 3-glycidoxypropylpentamethyl-disiloxane, and 3-glycidoxypropyltrimethoxysilane. Such materials are commercially available as GE4044 primer which is available from the General Electric Corporation.

As noted previously, the primer is applied to the outside of the sleeve prior to placing the base cushion elastomer around the sleeve. Of the primers listed, (3-glycidoxypropyl) bis(trimethylsiloxy)methylsilane and (3-glycidoxypropyl)-methyldiethoxysilane are preferred.

The base cushion material may be formed of any suitable silicone rubber, silicone polymer, fluorocarbon polymers or copolymers, fluoroelastomers or the like. Such materials are disclosed in U.S. Pat. No. 6,393,249B1, previously incorporated by reference. Such materials are considered to be well known to those skilled in the art and no novelty is claimed in the particular base cushion material selected. Preferably the base cushion material selected is a silicone resin or silicon rubber, since improved bonding is obtained using the primer of the present invention with these materials. Surprisingly superior adhesion has been achieved using these binders with high temperature nickel and silicone rubbers.

It is noted in U.S. Pat. No. 6,393,249B1, that a similar priming agent is used to secure a thick compliant base section to a strengthening band using GE4044 priming agent. This priming layer is used to bind the thick compliant cushion material to a flexible band having the form of a tubular belt, which may be metal, elastomer, plastic, or a reinforced material such as a fabric or a reinforced silicone belt. By contrast, the present invention uses a similar priming agent with a high temperature nickel and silicone rubbers and resins and with these materials achieve greatly superior results by comparison to previously used primers.

Positioned over the base cushion is an elastomer layer that can include any suitable low surface energy material suitable for the release of the toner images so that the toner images are not removed to any substantial extent from the receiver by the fuser roller.

In some instances, materials such as silicone rubber and the like have been used as the outer layer, but such materials are somewhat vulnerable to damage in long term use from release oil, which is typically applied to the heated fuser roller in fuser stations. Thermoplastic fluorocarbon polymers and thermoplastic fluorocarbon copolymers do not suffer this disadvantage. These materials have been found to be preferable to fluorocarbon resins, which do not have comparably low surface release energy. Typically, these thermoplastic fluorocarbon polymers and copolymers are positioned over the base cushion after sizing the base cushion to a desired size. They are then cured (at temperatures from about 220° C. to about 300° C.) in place to produce the desired cured thermoplastic fluorocarbon polymer or copolymer surface as a cured surface. Such materials are well known to those skilled in the art, and as mentioned previously, have been disclosed in U.S. Pat. Nos. 6,355,352B1 and 6,429,249B1, both previously incorporated herein by reference. The outer layer may include a thermoplastic fluorocarbon random copolymer containing a bisphenol curing agent residue and a particulate filler containing at least one of zinc oxide and an aminosiloxane. The outer layer may alternatively include a thermoplastic fluorocarbon random copolymer containing a bisphenol curing agent residue, a particulate filler containing zinc oxide, an aminosiloxane, and antimony-doped tin oxide particles.

Typically, the base cushion can vary in thickness from about 0.6 mm or less up to about 50 mm or more, dependent upon whether it is desired to produce a hard or a compliant roller. Such variations are known to those skilled in the art, as are the advantages of using either hard or compliant rollers. Similarly, the thickness of the cured thermoplastic fluorocarbon polymers and copolymers is typically from about 0.025 mm to about 0.25 mm. The thickness of these materials on the cushion layer is readily varied by changing the viscosity of the coating solution, curing time, coating method, coating speed and the like, as well known to those skilled in the art.

By the present invention, either hard or compliant replaceable fuser rollers can be produced without the need for additional layers, stiffening layers or the like.

Accordingly, the roller of the present invention is of relatively simple construction but provides the flexibility to provide both hard and compliant rollers, which provide a low energy surface for the release of toner during the fusing step while providing simplicity of construction. A major component of this simplicity is the ability to achieve the surprisingly superior bonding between the base cushion layer and the high temperature nickel using the primers discussed above. As demonstrated in the following examples, surprising improvements in the adhesion of the base cushion to high temperature nickel are achieved using the primers of the present invention.

This use of the primers of the present invention achieves a substantial improvement in the production of such replaceable fuser members. The improvement is particularly pronounced with high temperature nickel. The improvement is also realized with bright chromate high temperature nickel. The improvement is particularly significant with silicone rubbers and silicone polymers.

The replaceable fuser members of the present invention are readily produced by techniques whereby the primer is applied by any suitable method such as spraying, painting, ring coating or the like to the outside of the sleeve, which is desirably positioned on a mandrel during the formation of the replaceable fuser member. Any method suitable to apply the primer relatively uniformly on the outside of the sleeve is suitable. The base cushion is then blade coated, injection molded, transfer molded, compression molded, or otherwise applied to the outside of the sleeve as primed. The base cushion is deposited to a suitable thickness, which is greater than the desired end thickness for the base cushion layer. The base cushion layer is then machined (typically by grinding and polishing) to a desired thickness and the thermoplastic polyfluorocarbon polymers or copolymers are applied by any suitable method such as ring coating, transfer coating, spray coating or the like, to the exterior of the base cushion layer. Thereafter, the fuser member is heated to a suitable temperature for a suitable time to cure the thermoplastic fluorocarbon polymers, copolymers or mixtures thereof used to coat the base cushion layer.

A more detailed description of the method for producing the replaceable fuser member of the present invention is described in co-pending, commonly assigned, U.S. Provisional Patent Application Ser. No. 60/433,155, filed Dec. 13, 2002, entitled "METHOD FOR PRODUCING REPLACEABLE FUSER MEMBER" by Jiann-Hsing Chen, et al.

EXAMPLE 1

Metal samples of the compositions shown in Table 1 were prepared. These samples were prepared as metal plates having a size of about 4 inches by 8 inches. The surfaces of these metal surfaces were cleaned with ethanol and methylethylketone, thereafter GE4044 primer (a primer containing a silane coupling agent containing epoxies) was applied to these plates. Thereafter, a silicone rubber EC4952, available from Emerson and Cuming, Billerica, Massachusetts, was coated onto the metal plates and the samples were cured for thirty hours as follows. A twelve-hour ramp up time was used to reach a temperature of 205° C. and the temperature was held at 205° C. for eighteen hours. The adhesion of the silicone rubber to the test panels was tested with a peel test analyzer "Chatillion LTC M6," which was used to determine the adhesion values reported. The "Chatillion LTC M6" was obtained from Ametek Company, 8600 Somerset Drive, Largo, Fla. 33773. A surprising improvement in adhesion was achieved with the high temperature nickel, and the bright chromate high-temperature nickel. With these materials adhesion increases of eighteen to twenty fold were realized by comparison to unprimed plates. Much lesser improvements were realized with copper, copper-black oxide and electroformed nickel.

TABLE 1

| | SLEEVE COMPOSITION UNPRIMED (g) | ADHESION PRIMED (g) | IMPROVEMENT PRIMED/ UNPRIMED |
|---|---|---|---|
| COPPER | 16.06 | 5.17 | 0.32 |
| COPPER, BLACK OXIDE | 22.96 | 188.86 | 8.2 |
| BRIGHT CHROMATE | 7.39 | 154.60 | 20.9 |

TABLE 1-continued

| | SLEEVE COMPOSITION UNPRIMED (g) | ADHESION PRIMED (g) | IMPROVEMENT PRIMED/ UNPRIMED |
|---|---|---|---|
| HIGH TEMPERATURE NICKEL | | | |
| HIGH TEMPERATURE NICKEL | 9.63 | 176.40 | 18.3 |
| NICKEL (ELECTRO-FORMING) | 6.02 | 25.93 | 4.3 |

As shown in the preceding example, the high temperature nickel has more desirable properties for use in the production of the replaceable fuser roller members than the electroformed nickel. Superior adhesion of the base cushion materials to the high temperature nickel is achieved using the primers of the present invention. The replaceable fuser roller member of the present invention permits the flexibility to produce hard or compliant rollers with a minimum of layers and in a form such that the fuser roller member is readily replaced by the user of an electrophotographic machine. Accordingly, the fuser roller member of the present invention provides many advantages and improvements over previously known fuser roller members, many of these advantages are attributable to the superior adhesion achieved by the use of the primer of the present invention, especially when used with high temperature nickel in combination with silicone rubbers or silicone resins or polymers.

Previously, rollers adapted for use as either hard or compliant rollers required stiffening bands and other materials in order to achieve the desired range of properties. Such devices are not required with Applicants' claimed invention.

While the present invention has been described by reference to certain of its preferred embodiments, it is pointed out that the embodiments described are illustrative rather than limiting in nature and that many variations and modifications are possible within the scope of the present invention. Many such variations and modifications may be considered obvious and desirable by those skilled in the art based upon a review of the foregoing description of preferred embodiments.

What is claimed is:

1. A replaceable fuser roller member, the member comprising:

a) a high temperature nickel sleeve snugly positioned around a mandrel in an electrophotographic machine fuser section, the sleeve having an inner diameter adapted to closely fit around an outer diameter of the mandrel;

b) a base cushion elastomer layer around an outside of the sleeve;

c) a primer consisting essentially of a silane coupling agent containing epoxies positioned on the outside of the sleeve to provide bonding between the base cushion and the sleeve; and d) a layer of a cured thermoplastic polymer selected from the group consisting of thermoplastic polyfluorocarbon polymers and thermoplastic polyfluorocarbon random copolymers around the outside of the base cushion.

2. The member of claim 1, wherein said sleeve is of the same metal as the mandrel.

3. The member of claim 1, wherein said sleeve is of a thickness from about 0.001 to about 0.05 inches.

4. The member of claim 1, wherein said mandrel is of a metal having a coefficient of thermal expansion near a coefficient of thermal expansion of the sleeve.

5. The member of claim 1, wherein said sleeve has an inside diameter from about 0.00 1 to about 0.002 inches greater than the outer diameter of the mandrel.

6. The member of claim 1, wherein said base cushion elastomer layer is selected from the group consisting of silicone rubbers, silicon polymers, silicone rubbers containing fillers and silicone polymers containing fillers.

7. The member of claim 6, wherein said base cushion elastomer comprises polydimethylsiloxane.

8. The member of claim 6, wherein said base cushion elastomer contains at least one filler and is thermally conductive.

9. The member of claim 1, wherein said primer contains at least one of the group consisting of, (3-glycidoxypropyl) bis(trimethylsiloxy)methylsilane, 3-glycidoxypropyldimethylethoxysilane, (3-glycidoxypropyl)methyldiethoxysilane, 3-glycidoxypropylmethyl-di-isopropenoxysilane, 3-glycidoxypropylpentamethyl-disiloxane, and 3-glycidoxypropyltrimethoxysilane.

10. The member of claim 9, wherein said primer is applied to the outside of the sleeve prior to positioning the base cushion elastomer around the sleeve.

11. The member of claim 1, wherein said primer contains at least one of the group consisting of, (3-glycidoxypropyl) bis(trimethylsiloxy)methylsilane, 3-glycidoxypropyldimethylethoxysilane, (3-glycidoxypropyl)methyldiethoxy-silane, 3-glycidoxypropylmethyl-di-isopropenoxysilane, 3-glycidoxypropyl-pentamethyl-disiloxane, and 3-glycidoxypropyltrimethoxysilane, wherein the base cushion elastomer contains at least one of silicone rubbers, silicon polymers, silicone rubbers containing fillers to increase thermal conductivity and silicone polymers containing fillers and wherein the sleeve is of high temperature nickel.

12. The member of claim 11, wherein said primer contains, (3-glycidoxypropyl)bis(trimethylsiloxy)methylsilane.

13. The member of claim 11, wherein said primer contains, (3-glycidoxypropyl)methyldiethoxysilane.

14. The member of claim 1, wherein said cured thermoplastic polymer is a thermoplastic fluorocarbon random copolymer containing a bisphenol curing agent residue, and a particulate filler containing at least one of zinc oxide and an aminosiloxane.

15. The member of claim 1, wherein said cured thermoplastic polymer is a thermoplastic fluorocarbon random copolymer containing a bisphenol curing agent residue, a particulate filler containing zinc oxide, an aminosiloxane and antimony-doped tin oxide particles.

16. The member of claim 1, wherein said cured thermoplastic polymer has been cured at a temperature from about 220 to about 300° C.

17. The member of claim 1, wherein said sleeve has a thickness from about 0.002 to about 0.030 inches.

18. The member of claim 1, wherein said base cushion has a thickness from about 0.6 to about 50 mm.

* * * * *